US012728343B2

(12) United States Patent
Crichton et al.

(10) Patent No.: US 12,728,343 B2
(45) Date of Patent: Sep. 8, 2026

(54) ROLLER SKATE

(71) Applicant: Stateside Skates Ltd., London (GB)

(72) Inventors: Alistair Crichton, Farnborough (GB); Jacob Bach Vorre, Aarhus (DK)

(73) Assignee: STATESIDE SKATES LTD., London (GB)

( * ) Notice: Subject to any disclaimer, the term of this patent is extended or adjusted under 35 U.S.C. 154(b) by 303 days.

(21) Appl. No.: 18/595,733

(22) Filed: Mar. 5, 2024

(65) Prior Publication Data

US 2025/0281814 A1 Sep. 11, 2025

(51) Int. Cl.
*A63C 17/06* (2006.01)

(52) U.S. Cl.
CPC ..... *A63C 17/068* (2013.01)

(58) Field of Classification Search
CPC .... A63C 1/02; A63C 1/06; A63C 1/20; A63C 1/22; A63C 17/0073; A63C 17/226; A63C 17/068; A63C 2203/42
See application file for complete search history.

(56) References Cited

U.S. PATENT DOCUMENTS 3,936,061 A * 2/1976 Wada ..... A63C 17/0086 280/11.26
5,803,466 A * 9/1998 Wrike ..... A63C 17/068 280/11.27
6,042,124 A * 3/2000 Cheatham ..... A63C 17/068 280/11.19
6,247,708 B1 * 6/2001 Hsu ..... A63C 17/20 280/11.27
6,572,120 B2 * 6/2003 Chang ..... A63C 17/008 280/11.233
7,175,187 B2 * 2/2007 Lyden ..... A63C 17/02 280/11.232

FOREIGN PATENT DOCUMENTS

CA 2181212 C * 6/2003
FR 2562803 A1 * 10/1985 ..... A63C 17/061
KR 200326938 Y1 * 9/2003 ..... A63C 17/20

OTHER PUBLICATIONS

CA-2181212-C English Translation (Year: 2003).*
KR-200326938-Y1 English Translation (Year: 2003).*
FR-2562803-A1 English Translation (Year: 1985).*

* cited by examiner

*Primary Examiner* — Michael T. Walsh
(74) *Attorney, Agent, or Firm* — MUNCY, GEISSLER, OLDS & LOWE, P.C.

(57) ABSTRACT

A roller skate is provided, wherein the roller skate includes: a boot including a body portion and a sole, the sole having a longitudinal direction and including two receptacles arranged in interval in the longitudinal direction, each receptacle including a wall and at least one slot open on the sole toward the longitudinal direction, the wall defining at least one opening of the at least one slot; a roller assembly including a frame and rollers disposed on the frame, the frame including two insertion portions arranged in interval in the longitudinal direction, the two insertion portions being respectively insertable in and detachable from the two receptacles in the longitudinal direction, each insertion portion being blocked by the wall of one of the two receptacles in a blocking direction away from the sole; and a plurality of fasteners securing the frame to the sole.

8 Claims, 5 Drawing Sheets

ROLLER SKATE

BACKGROUND OF THE INVENTION

Field of the Invention

The present invention relates to a roller skate.

Description of the Prior Art

The roller assembly of one kind of conventional roller skate is fastened to the sole of the boot through many fasteners (such as screws). Therefore, it has to form holes on the frame of the roller assembly and the sole of the boot, respectively, for the fasteners to pass through. The structure is complex, difficult to process and manufacture, and inconvenient to assemble and disassemble. The roller assembly of another kind of conventional roller skate includes projections projecting toward the sole of the boot, and the sole of the boot is recessed with slots. After one of the projections is inserted in one of the slots, another one of the projections is then swung to be within another one of the slots and then locked by a locking or latching member. Similarly, the structure is complex, difficult to process and manufacture, and unstable.

The present invention is, therefore, arisen to obviate or at least mitigate the above-mentioned disadvantages.

SUMMARY OF THE INVENTION

The main object of the present invention is to provide a roller skate which has a simple and stable combination structure, and is easy and quick to assemble and disassemble directly from the lateral side.

To achieve the above and other objects, a roller skate is provided, wherein the roller skate includes: a boot including a body portion and a sole, the sole having a longitudinal direction and including two receptacles arranged in interval in the longitudinal direction, each of the two receptacles including a wall and at least one slot open on the sole toward the longitudinal direction, the wall defining at least one opening of the at least one slot; a roller assembly including a frame and a plurality of rollers disposed on the frame, the frame including two insertion portions arranged in interval in the longitudinal direction, the two insertion portions being respectively insertable in and detachable from the two receptacles in the longitudinal direction, each of the two insertion portions being blocked by the wall of one of the two receptacles in a blocking direction away from the sole; and a plurality of fasteners securing the frame to the sole The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
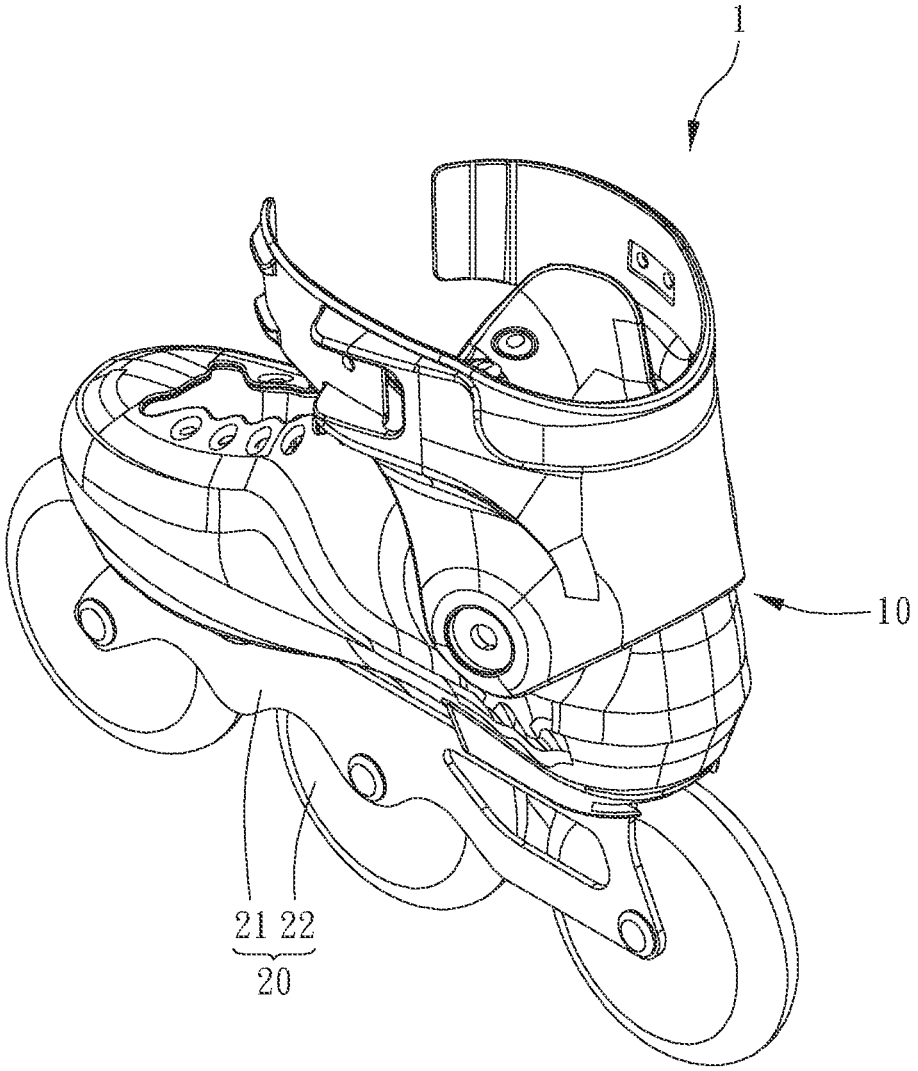
FIG. 1 is a stereogram of an exemplary embodiment of the present invention.
Figure 2:
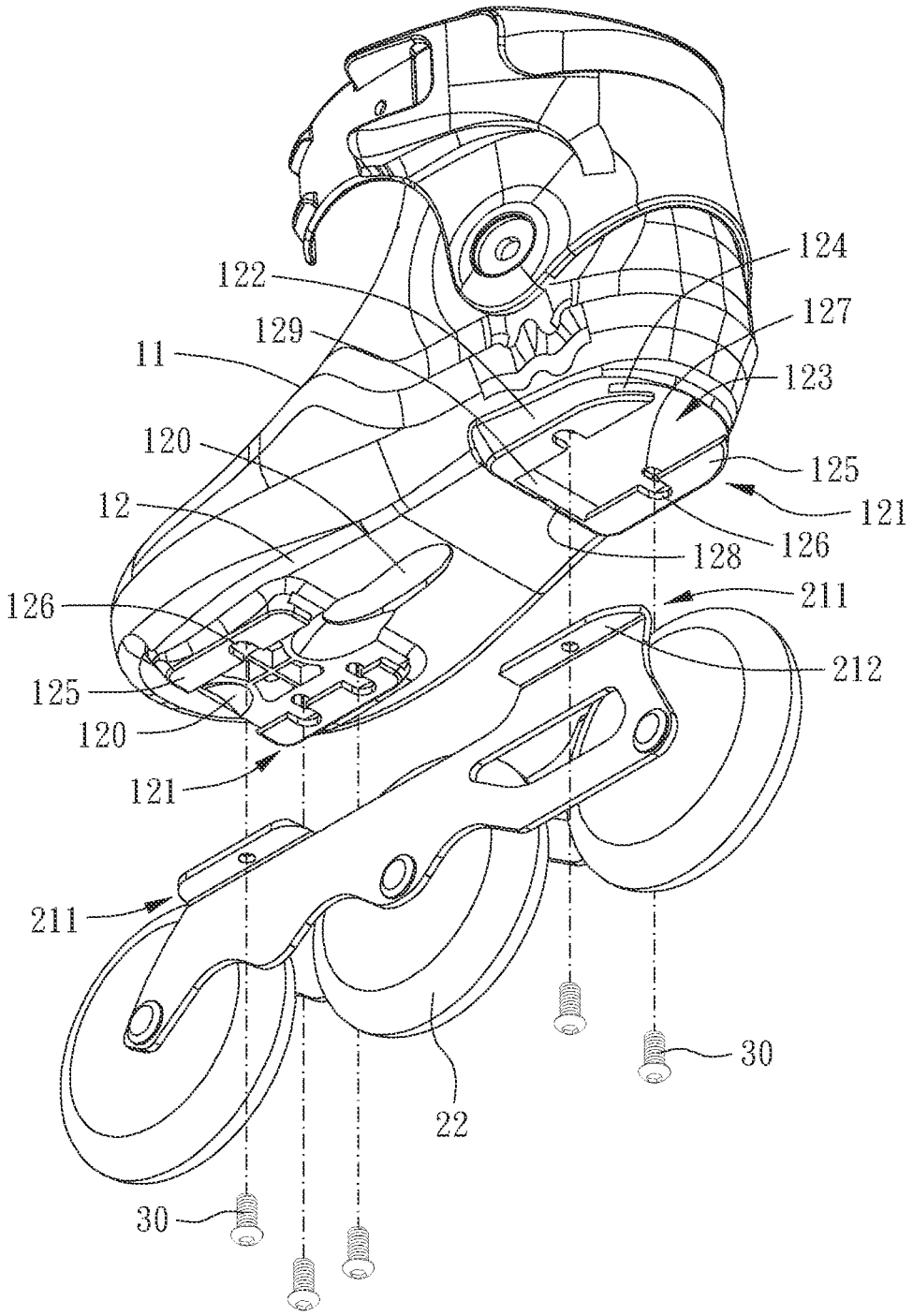
FIG. 2 is a breakdown drawing of an exemplary embodiment of the present invention.

Please refer to FIGS. 1 to 4 for an exemplary embodiment of the present invention. A roller skate 1 of the present invention includes a boot 10, a roller assembly 20 and a plurality of fasteners 30.

The boot 10 includes a body portion 11 and a sole 12, the sole 12 has a longitudinal direction D1 and includes two receptacles 121 arranged in interval in the longitudinal direction D1, and the two receptacles 121 may be integrally formed on the sole 12 or additionally secured to the sole 12. Each of the two receptacles 121 includes a wall 122 and at least one slot 123 open on the sole 12 toward the longitudinal direction D1, and the wall 122 defines at least one opening 124 of the at least one slot 123. The roller assembly 20 includes a frame 21 and a plurality of rollers 22 disposed on the frame 21, the frame 21 includes two insertion portions 211 arranged in interval in the longitudinal direction D1, and the frame 21 may be integrally formed of one piece or a multi-piece structure. The two insertion portions 211 are respectively insertable in and detachable from the two receptacles 121 in the longitudinal direction D1, and each of the two insertion portions 211 is blocked by the wall 122 of one of the two receptacles 121 in a blocking direction D2 away from the sole 12. The plurality of fasteners 30 secures the frame 21 to the sole 12. As such, the roller skate 1 has a simple and stable combination structure, and the frame 21 is easy and quick to assemble and disassemble directly from the lateral side.

The sole 12 further has a width direction D3, the wall 122 includes a plurality of blocking flanges 125 arranged in interval in the width direction D3 and extending in the width direction D3, each of the two insertion portions 211 includes a plurality of engaging flanges 212 arranged in interval in the width direction D3 and extending in the width direction D3, and the plurality of engaging flanges 212 are inserted in the at least one slot 123 and blocked by the plurality of blocking flanges 125 in the blocking direction D2. The plurality of engaging flanges 212 may be additionally connected to or integrally formed with the frame 21.

Specifically, each of the plurality of blocking flanges 125 includes at least one perforation 126 disposed therethrough in the blocking direction D2, and each of the plurality of fasteners 30 is disposed through one of the plurality of engaging flanges 212 and one of the at least one perforation 126 and connected to the sole 12. The at least one the perforation 126 is open on a lateral side of at least one of the plurality of blocking flanges 125 in the width direction D3. The sole 12 further includes a plurality of through holes 127. Each of the plurality of through holes 127 is elongated in the width direction D3, which allows adjustment of the roller assembly 20. A part of the plurality of through holes 127 may be open toward a direction inclined to the blocking direction D2, and another part of the plurality of through holes 127 may be open toward a direction parallel to the blocking direction D2, which is conducive to the dispersion and transmission of force. The at least one perforation 126 of one of the plurality of blocking flanges 125 and the at least one perforation 126 of another one of the plurality of blocking flanges 125 are of different numbers and disposed offset in the longitudinal direction D1 relative to each other, which provides greater structural strength and better stability between the boot 10 and the roller assembly 20, and is conducive to force transmission.

Preferably, the wall 122 of one of the two receptacles 121 further includes a protrusion 128 between two of the plurality of blocking flanges 125, and one of the two insertion portions 211 is blocked by the protrusion 128 in the longitudinal direction D1, which quickly aligns the plurality of blocking flanges 125 and the plurality of engaging flanges 212, and firmly and stably secure the frame 21. The protrusion 128 includes an inclined surface 129, the inclined surface 129 extends in the width direction D3 and is inclined to the blocking direction D2, and the engaging flange 212 of one of the two insertion portions 211 includes an inclined surface 213 abutted against the inclined surface 129 of the protrusion 128. During assembling, the inclined surface 129 and the inclined surface 213 can slide relative to each other to make the plurality of blocking flanges 125 and the plurality of engaging flanges 212 more firmly against each other.

Figure 3:
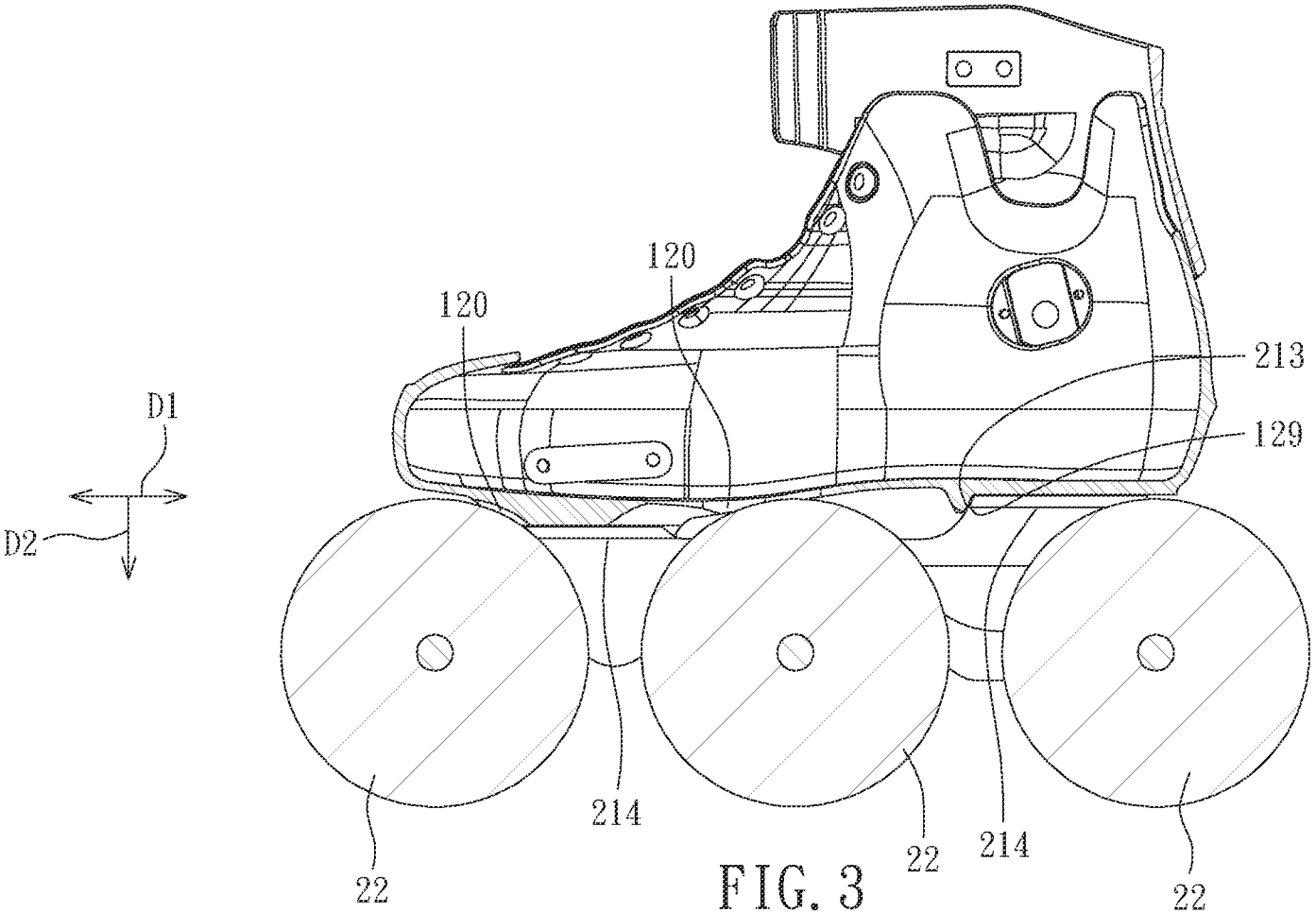
FIG. 3 is a cross-sectional view of an exemplary embodiment of the present invention.
Figure 4:
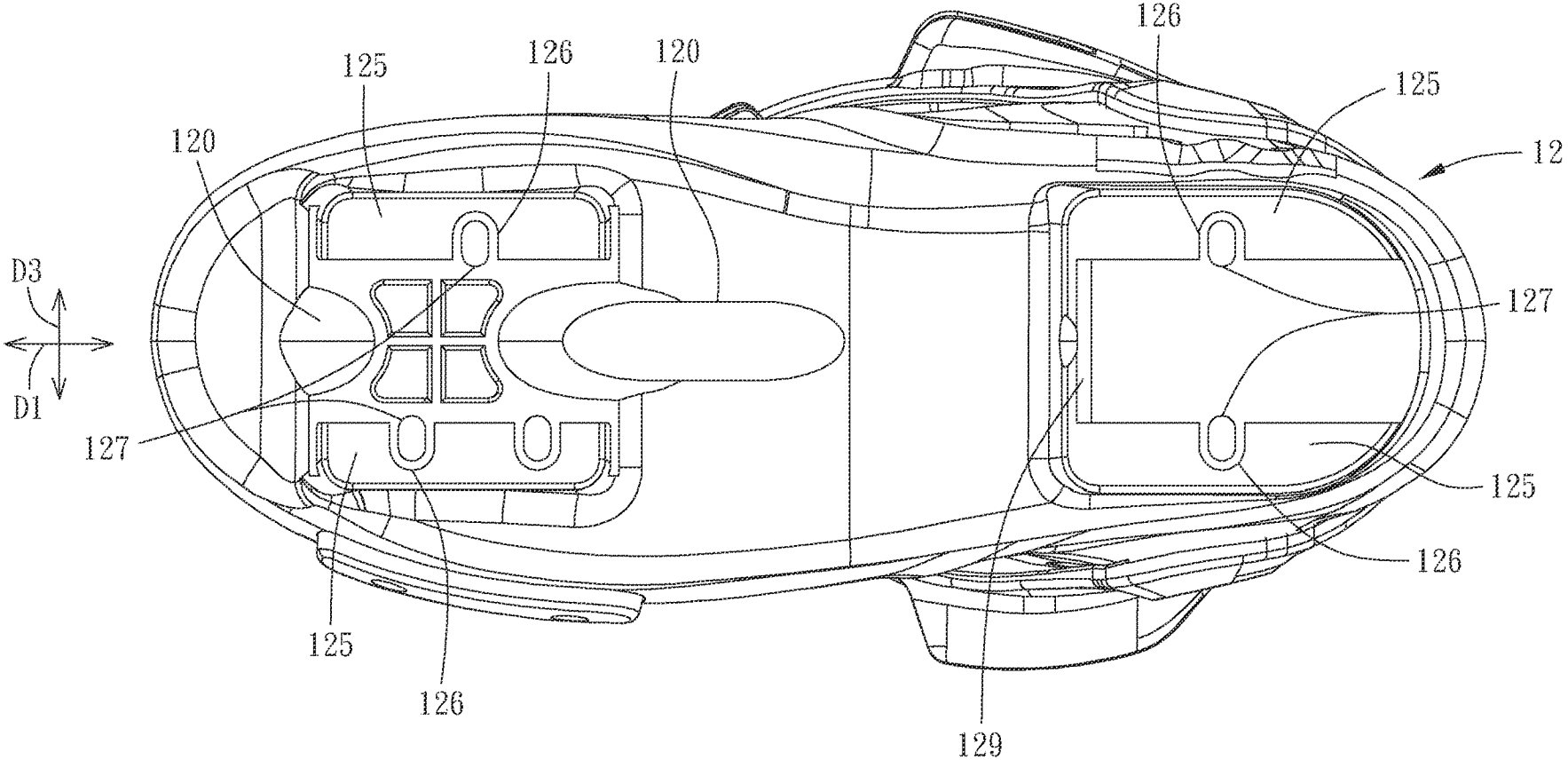
FIG. 4 is a bottom view of a boot according to an exemplary embodiment of the present invention.
Figure 5:
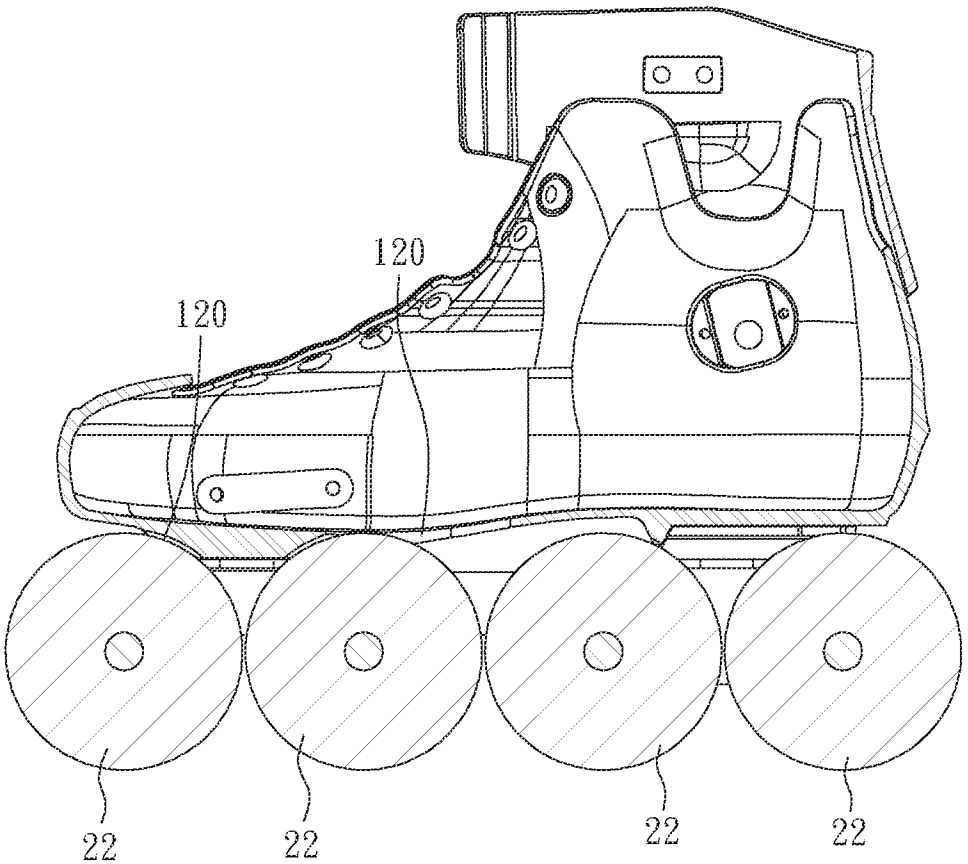
FIG. 5 is a cross-sectional view of another exemplary embodiment of the present invention.

Preferably, a top end of at least one of the plurality of rollers 22 is higher than all bottom surfaces 214 of the plurality of engaging flanges 212, the sole 12 further includes at least one groove 120, and at least one of the plurality of rollers 22 is partially within the at least one groove 120 and located between top and bottom sides of the sole 12, which lowers the center of gravity of the roller skate. In this embodiment, at least one the groove 120 is disposed through the sole 12, and this allows a relatively larger region of the roller 22 to be accommodated in the groove 120, thereby lowering the center of gravity of the roller skate and facilitating air circulation. In the longitudinal direction D1, one of the at least one groove 120 between the two receptacles 121 has a length larger than a radius of each of each of the plurality of rollers 22, which is applicable to roller assemblies that includes different numbers of rollers (FIG. 3 and FIG. 5).

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A roller skate including:

a boot including a body portion and a sole, the sole having a longitudinal direction and including two receptacles arranged in interval in the longitudinal direction, each of the two receptacles including a wall and at least one slot open on the sole in the longitudinal direction, the wall defining at least one opening of the at least one slot;

a roller assembly including a frame and a plurality of rollers disposed on the frame, the frame including two insertion portions arranged in interval in the longitudinal direction, the two insertion portions being respectively insertable in and detachable from the two receptacles in the longitudinal direction, each of the two insertion portions being blocked by the wall of one of the two receptacles in a blocking direction projecting vertically away from the sole; and a plurality of fasteners securing the frame to the sole;

wherein the sole is integrally formed of one piece, and each of the two receptacles is integrally formed as a part of the sole;

wherein the sole further has a width direction, the wall includes a plurality of blocking flanges arranged in interval in the width direction and extending in the width direction, each of the two insertion portions includes a plurality of engaging flanges arranged in interval in the width direction and extending in the width direction, and the plurality of engaging flanges are inserted in the at least one slot and blocked by the plurality of blocking flanges in the blocking direction;

wherein each of the plurality of blocking flanges includes at least one perforation disposed therethrough in the blocking direction, and each of the plurality of fasteners is disposed through one of the plurality of engaging flanges and one of the at least one perforation and connected to the sole;

wherein the at least one perforation is open on a lateral side of at least one of the plurality of blocking flanges in the width direction, and the at least one perforation is closed on another lateral side of the at least one of the plurality of blocking flanges in the width direction.

2. The roller skate of claim 1, wherein the at least one perforation of one of the plurality of blocking flanges and the at least one perforation of another one of the plurality of blocking flanges are of different quantities and disposed offset in the longitudinal direction relative to each other.

3. The roller skate of claim 1, wherein a top circumferential surface of at least one of the plurality of rollers is higher than all bottom surfaces of the plurality of engaging flanges.

4. The roller skate of claim 1, wherein the sole further includes at least one groove, and at least one of the plurality of rollers is partially within the at least one groove and located between two sides of the sole.

5. The roller skate of claim 4, wherein one of the at least one groove is disposed through the sole.

6. The roller skate of claim 4, wherein in the longitudinal direction, one of the at least one groove between the two receptacles has a length larger than a radius of each of the plurality of rollers.

7. The roller skate of claim 1, wherein the wall of one of the two receptacles further includes a protrusion between two of the plurality of blocking flanges, and one of the two insertion portions is blocked by the protrusion in the longitudinal direction.

8. The roller skate of claim 7, wherein the protrusion includes an inclined surface, the inclined surface extends in the width direction and is inclined to the blocking direction, and the engaging flange of one of the two insertion portions includes an inclined surface abutted against the inclined surface of the protrusion.

* * * * *